US006694987B2

(12) United States Patent
Thiebaut

(10) Patent No.: US 6,694,987 B2
(45) Date of Patent: Feb. 24, 2004

(54) APPLICATOR UNIT

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 31 days.

(21) Appl. No.: 10/066,705

(22) Filed: Feb. 6, 2002

(65) Prior Publication Data

US 2002/0108629 A1 Aug. 15, 2002

(30) Foreign Application Priority Data

Feb. 6, 2001 (FR) ..... 01 01571

(51) Int. Cl.[7] ..... A45D 33/28; A45D 33/24; A45D 40/24

(52) U.S. Cl. ..... 132/297; 132/294; 132/317

(58) Field of Search ..... 132/297, 294, 132/317, 301, 218, 318, 316; 206/235, 581, 229; 401/123, 125

(56) References Cited

U.S. PATENT DOCUMENTS

| | | | | | |
|---|---|---|---|---|---|
| 1,546,219 | A | * | 7/1925 | Enzer et al. | 132/297 |
| 2,294,257 | A | * | 8/1942 | Udvarhely et al. | 132/317 |
| 2,825,085 | A | * | 3/1958 | Ingraham | 132/317 |
| 2,951,489 | A | | 9/1960 | Roberts | |
| 3,613,697 | A | * | 10/1971 | Andrews | 132/297 |
| 3,760,820 | A | | 9/1973 | Seidler | |
| 4,308,879 | A | * | 1/1982 | Thornbloom | 132/317 |
| 5,611,361 | A | * | 3/1997 | Leone | 132/218 |
| 5,941,254 | A | * | 8/1999 | Heler | 132/297 |
| 6,002,651 | A | * | 12/1999 | Baccaray | 368/10 |
| 6,073,634 | A | * | 6/2000 | Gueret | 132/218 |
| 6,309,124 | B1 | | 10/2001 | Gueret | |
| 2001/0032656 | A1 | | 10/2001 | Kingsford et al. | |

FOREIGN PATENT DOCUMENTS

| | | |
|---|---|---|
| EP | 0 261 750 | 3/1988 |
| EP | 0 960 582 | 12/1999 |
| EP | 1 020 135 | 7/2000 |
| EP | 1 118 286 | 7/2001 |
| FR | 1 020 647 | 2/1953 |
| FR | 2 759 872 | 8/1998 |
| GB | 2 139 886 | 11/1984 |

OTHER PUBLICATIONS

English language Derwent Abstract of EP 0 960 582, Dec. 1, 1999.

* cited by examiner

*Primary Examiner*—John J. Wilson
*Assistant Examiner*—Robyn Kieu Doan
(74) *Attorney, Agent, or Firm*—Finnegan Henderson Farabow Garrett & Dunner, L.L.P.

(57) ABSTRACT

The present application may include an applicator unit comprising an application member and a first part defining at least a first compartment and a second compartment. The first compartment may be configured to accommodate a product to be applied and may comprise a first opening extending substantially in a plane. The second compartment may be configured to accommodate an application member via a second opening. The applicator unit may further include a second part comprising a handle. The application member may be located at an end of the handle. The applicator unit may also comprise a retainer configured to releasably retain the first and second parts in an assembled position. The first part and the second parts may be configured so that, in the assembled position, the first and second openings are closed and the handle is arranged at least partially over the first opening. In the assembled position, the handle may define a portion of an external surface of the unit, and the application member may be arranged in the second compartment on an opposite side of the plane than the first compartment.

53 Claims, 4 Drawing Sheets

APPLICATOR UNIT

The present invention relates to an applicator unit, such as one that may be used in the field of cosmetics. More particularly, the present invention relates to an applicator unit that could be used for packaging and/or applying products, such as makeup or body care products (e.g., eyeshadows, blushers, lip make-ups, mascaras, and/or foundations).

Make-up products may generally be applied by using, for example, an applicator or directly with the fingers, among other methods. Applicators often may be of a small size that may sometimes make it difficult to locate the applicators when stored in a handbag, for example. Furthermore, when stored in a handbag, it may be desirable for the applicator to be protected from dust and other dirt that may be present in the handbag. Conversely, it may be desirable that the applicator, on which a quantity of residual product may remain, not soil the contents of the handbag. As such, the applicator may often be protected by a compartment, which may be separate or may be part of a packaging unit for the product to be applied (e.g., a container). When the applicator is protected by a compartment that is a part of a container, for example, so as not to increase the size of the container inordinately, the applicator may often be of very small size, which may make it more difficult to handle.

If the product is applied directly with the fingers, the user may need to have a nearby source of water for washing her hands after application.

U.S. Pat. No. 3,760,820 describes an applicator for a make-up product comprising a first part delimiting a first compartment for accommodating a product to be applied. The first compartment has an opening, opposite a base, extending substantially in a plane. The first part also comprises a second compartment for accommodating an application member in the assembled position of the first and second parts. The applicator unit also comprises a second part comprising the application member at the end of a handle. In the assembled position, the handle covers the opening of the first compartment, and the application member is arranged in the second compartment substantially on the same side of the plane as the first compartment.

A possible drawback of this design relates to the complexity of the action required to assemble the two parts. Assembly may be achieved, for example, by a combined movement of the second part on the one hand along the axis of the unit and on the other hand by pivoting around a moving point. Besides the complexity, this assembly action may also risk damaging the applicator both when removing the applicator and when returning it after application. Overall, the unit as designed may be fragile.

Other designs of a similar type are described in U.S. Pat. No. 2,951,489, FR-A-2 759 872, EP-A-0 960 582, GB-A-2 139 886 and EP-A-0 261 750. All of these documents describe devices suffering from at least one drawback. For example, in these references, releasing the opening of the compartment containing the product in order to remove product by means of the applicator and taking up the applicator by hand may require a sequence of two or more actions that are not necessarily simple to complete. Generally, there is a sliding movement for withdrawing the applicator or for releasing its application part, and a pivoting movement of a lid for opening the compartment containing the product. If the device includes a mirror for assisting application, at least three actions may be required. Furthermore, in many of these documents, the applicator may be very small in size, which may make it less accurate to handle.

FR-A-1 020 647 describes a make-up container formed from two components fitting together by low friction sliding, and containing a compartment of make-up, a brush-carrier sheath, a brush, and a mirror.

When opening the container, the user first separates the parts forming the outer container from one another to permit access to the brush handle arranged inside the container. Then, with the brush handle, the user may withdraw the brush from its compartment in such a way as to release a pivoting lid covering the compartment containing the make-up. Finally, she may open the lid and remove the product by means of the applicator brush. The action required to open this container thus may be a complicated one as well. With this design, there also may be a risk of losing the outer container that is taken apart for application.

One of the optional aspects of the invention may include an applicator unit that addresses one or more of the problems discussed above with reference to conventional applicator units.

Another optional aspect of the invention may include an applicator unit permitting an action that may be simplified compared with the action associated with conventional devices.

Still another optional aspect of the invention may include an applicator unit that may be visually appealing, simple to use, and economic to produce.

Yet another optional aspect of the invention may be to provide for the use of an applicator, that may be easy and accurate to handle, without substantially affecting the overall size characteristics of the applicator unit.

Further optional aspects of the invention may become apparent from the description below.

According to one aspect, the invention may include an applicator unit comprising an application member and a first part defining at least a first compartment and a second compartment. The first compartment may be configured to accommodate a product to be applied and may comprise a first opening extending substantially in a plane. The second compartment may be configured to accommodate an application member via a second opening. The applicator unit may further include a second part comprising a handle. The application member may be located at an end of the handle. The applicator unit may also comprise a retainer configured to releasably retain the first and second parts in an assembled position.

The first and second parts may be configured so that, in the assembled position, the first and second openings are closed and the handle is arranged at least partially over the first opening. In the assembled position, the handle may also define a portion of an external surface of the unit, and the application member may be arranged in the second compartment on an opposite side of the plane than the first compartment.

According to another aspect, the retainer may be configured to reversibly lock the first part and the second part together in the assembled position.

The term "closed" as used herein with respect to the assembled position means that the first and/or second openings will keep in at least the product. For example, any loose product on the surface of the product in the first compartment or on the application member in the second compartment may not escape from the applicator device.

The configuration of the handle of the application member and the position of the application member in the assembled configuration of the applicator unit of the first and second parts may simplify the assembly action. For example, it may allow the assembly/disassembly of the first and second parts essentially by a sliding movement of the one relative to the other.

The present invention may permit the production of a unit for which, at least in a simple version, by means of a single action, it may be possible both to take up the applicator by hand and to access the product contained in the compartment formed by the first part. A limited number of parts may be required as compared with conventional units, such as the unit described in FR-A-1 020 647 mentioned above. This feature may make the device more economical to produce and more robust, while providing an appearance in keeping with the demands of fields such as cosmetics (e.g., make-up).

In another aspect, a cross sectional area of the handle in a plane parallel to the plane of the first opening may be at least as large as an area of the first opening, such that the handle may be capable of covering the first opening over substantially its entire cross section and/or entirely. The handle may therefore provide external protection either for the product by covering the first opening, or for an optional mirror that may be interposed between the first opening and the handle. For example, the handle may protect the entire reflecting surface of the mirror against dirt that may accumulate there if it were not protected. The handle may optionally provide protection for both the mirror and the opening when they are not superimposed.

A mirror between the first opening and the handle may facilitate the application of products such as make-up products.

In an optional aspect, the mirror may be able to occupy a position in which it at least partially covers the first opening, and it may move in relation to the first part, such as by a sliding movement, or about an axis perpendicular to the plane of the opening or parallel to the plane of the opening. The mirror could alternatively move about the axes as well.

When the applicator unit is in the assembled position, the mirror may cover the first opening in its entirety. Arranged in this way, it may contribute, in conjunction with the handle, to providing a quality closure of the compartment containing the product to be applied, and hence to improved protection for the latter.

Alternatively, the mirror may be fixedly mounted on the first part, next to the first opening, for example, around all or part of the first opening.

According to an optional aspect, in the assembled position of the unit, the handle may seal the first opening in a leaktight manner, and a mirror may be located next to the first opening. Sealing means (e.g., of the lip or seal type) may be used in conjunction with the handle to complete the sealing of the opening on closing with the handle.

In another optional aspect, the applicator unit has a longitudinal axis, and the first and second compartments may be offset along the longitudinal axis with respect to one another. For example, the first and second compartments may substantially abut one another along the longitudinal axis. This characteristic may give the applicator sufficient size (e.g., length), to offer easy and accurate handling.

The first part may be formed from a single molded component, for example, by gas injection molding. Optionally, the second part may be formed in the same way. The material used may be an ABS (acrylonitrile butadiene styrene), a SAN (styrene acrylonitrile), and/or a PS (polystyrene). Other materials may also be used according to the invention.

Unlike in the device described in GB-A-2 139 886 discussed above, the application member may be axially fixed with respect to the handle. The applicator may then be ready to apply the product upon removal from the applicator unit, without requiring another maneuver.

A guide means, for example a slideway, may be configured to guide a relative sliding movement of one of the parts with respect to the other. The guide means may facilitate assembly of the first and second parts. Alternatively, all or part of the edge of the compartment for accommodating the applicator may participate in guiding the applicator in its sliding movement. The guide means may also releasably retain the first and second parts in the assembled position (e.g., by clamping).

The releasable retaining of the first and second parts may also be provided by a reversible locking means, such as by snap fitting or by clamping, among others.

According to one aspect, in the assembled position of the two parts, the unit may have a generally cylindrical shape which may be chosen, for example, from one of a circular shape, a hexagonal shape, a square shape, an oval shape, or a rectangular shape, among others. A unit may be produced whose appearance may differ somewhat from conventional powder or eyeshadow containers, and may resemble more closely familiar units for applying products such as mascaras, lipsticks, or eyeliners.

The application member may comprise foam having, for example, one of open, semi-open or closed cells. The application member may also comprise a felt; a sintered material; for example, a ceramic or a thermoplastic; or an arrangement of bristles, such as in the form of a tuft substantially parallel to the axis of the handle. Other materials may be contemplated as well for use as an application member.

The product may be contained in a dish located inside the first compartment, wherein the dish is configured to accommodate the product. The dish may be removable from the first compartment, which may allow the unit to be refilled, for example, by a replacement dish full of product or by refilling the original dish with product. Alternatively, the dish may be non-removable and fixed, for example, by adhesive bonding or welding. Alternatively, the product may be located directly in the compartment reserved for it without the use of a dish.

According to the invention, the applicator device may have a plurality of compartments, with each compartment being designed, for example, to accommodate a product of one color unique to it. Inside the compartment (or compartments), the surface of the product may coincide with the plane of the opening. Alternatively, the exposed surface of the product may be domed to facilitate product removal. In this case, the corresponding surface of the handle may be hollowed out in a manner suitable for accommodating such a dome-shaped product.

The applicator unit according to the invention may furthermore comprise a second application member, such as a make-up pencil. The second application member may be secured to the first part and arranged such that, when the applicator unit is in the assembled position, it may be housed in a compartment formed by the second part.

The product contained in the compartment or compartments may be in the form of a solid or semi-solid cake. A solid block of product may be placed in the compartment directly in its solid form or, alternatively, the product may be hot or cold cast in the compartment, such that it assumes a solid form on solidification or setting of the composition. The products packaged in the form of such a solid cake may include an eyeshadow, a foundation, a blusher, or a mascara, for example. In the case of a lip makeup (e.g., lip rouge), for example, the product may be in the form of a paste.

According to another aspect, a method of applying a product may comprise providing an applicator unit as described herein. The method may also comprise separating the first part and the second part of the applicator unit from one another, loading product onto the applicator member, and applying product to an exterior body portion with the application member. For example, the product may be applied to skin.

The term "providing" is used broadly, and refers to, but is not limited to, making available for use, giving, supplying, obtaining, getting a hold of, acquiring, purchasing, selling, distributing, possessing, making ready for use, and/or placing in a position ready for use.

In another aspect, the retainer may be configured to lock the first and second parts together, and the separating of the first part from the second part may comprise unlocking the first part and the second part in a same motion used to separate the first part and the second part.

In yet another aspect, the applicator unit may further comprise product contained in the first compartment. The product may be chosen from one of eyeshadows, blushers, foundations, lip make-up (e.g. lip rouge), mascaras, or other cosmetic products.

According to a further aspect, the first opening may be fixed in relation to the second opening. Further, the first and second parts may be configured so that, in the assembled position, the handle and the first part cooperate to form at least part of a substantially continuous exterior surface, and the application member may be arranged in the second compartment on an opposite side of the plane in which the first opening substantially extends than the first compartment.

According to another aspect, the second opening faces in a direction that is not parallel to a direction that the first opening faces.

In another aspect, the first opening and the second opening may be offset from one another along a longitudinal axis of the applicator unit.

According to another aspect, the first opening may be fixed in relation to the second opening, and the first opening and the second opening may be offset from one another along a longitudinal axis of the applicator unit. In addition, the first and second parts may be configured so that, in the assembled position, the application member is arranged in the second compartment on an opposite side of the plane in which the first opening substantially extends than the first compartment.

In yet another aspect, the applicator unit may comprise a second application member, and the first and second parts may be configured so that, in the assembled position, the first application member is arranged in the second compartment on an opposite side of the plane than the first compartment. Optionally, in the assembled position, the first and second openings may be closed. The second application member may comprise a make-up pencil, for example.

In yet another aspect, the second application member may be secured to the first part and may be configured so that, in the assembled position, the second application member is housed in a compartment formed in the second part.

Besides the structural arrangements and procedural aspects described above, there could include a number of other arrangements, such as those explained hereinafter. It is to be understood that both the foregoing description and the following description are exemplary.

The accompanying drawings are incorporated in and constitute a part of this specification. The drawings illustrate exemplary embodiments of the invention and, together with the description, serve to explain certain principles. In the drawings, FIG. 1 is a perspective view of a disassembled applicator unit according to a first exemplary embodiment;

Reference will now be made in detail to exemplary embodiments of the invention, examples of which are illustrated in the accompanying drawings. Wherever possible, the same reference numbers are used in the drawings and the description to refer to the same or like parts.

Figure 1:
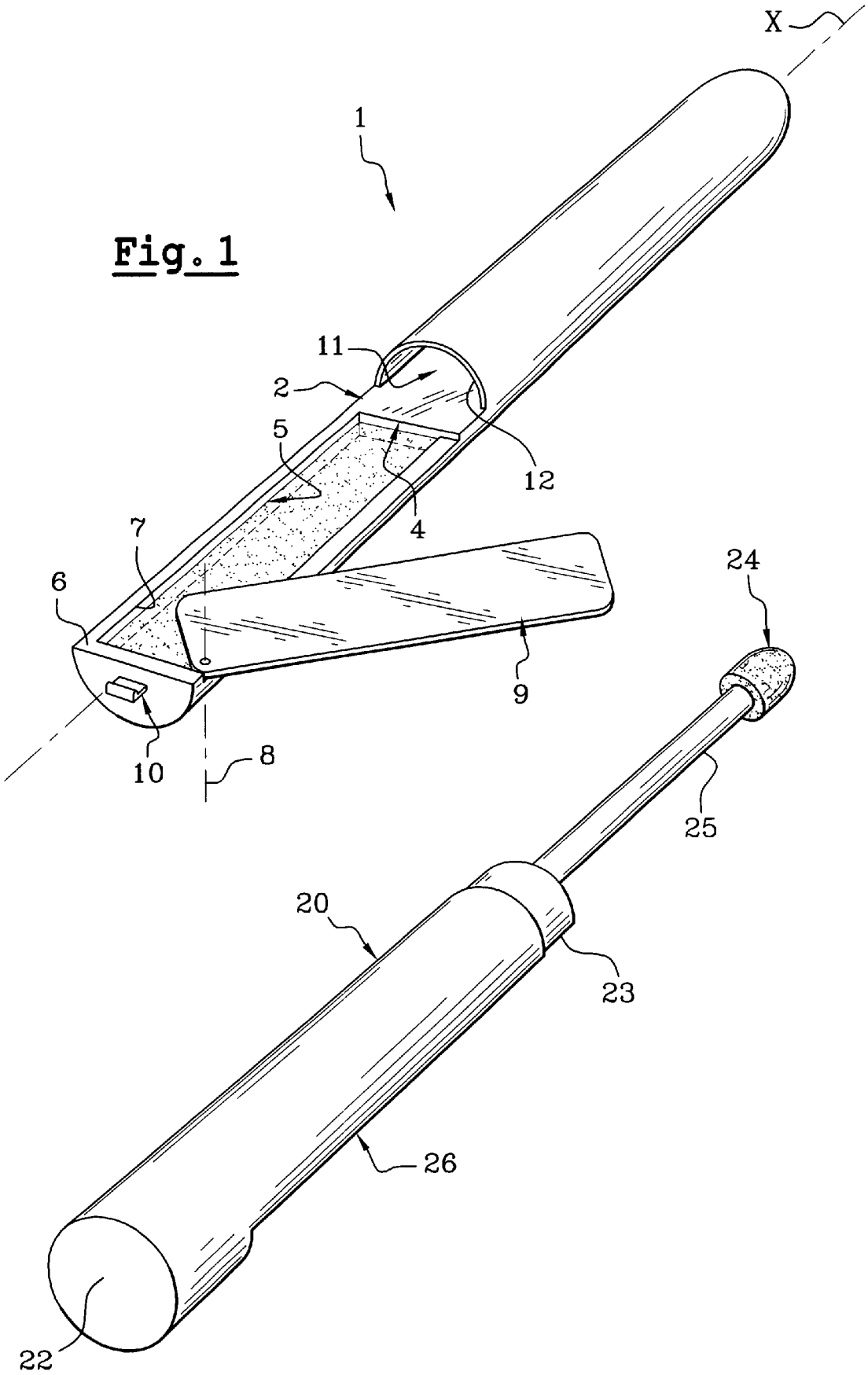

The applicator unit 1 according to the embodiment illustrated in FIGS. 1 and 2A–2C may comprise a first part 2 and a second part 20. The two parts 2, 20 may be made of acrylonitrile butadiene styrene, for example. The first part 2 may comprise a first portion extending over approximately half the axial length of the device 1 and forming a semi-cylinder in which a first compartment 4 is formed. Inside the compartment 4, the applicator unit 1 may comprise a plastic dish 5 containing a solid block of eyeshadow or other cosmetic product.

The first compartment 4 includes a first opening that extends substantially in a sectional plane 6. The first opening 7 may have a cross section substantially identical to the cross section of the first compartment 4 or less than the cross section of the compartment 4. The dish 5 may be held inside the first compartment 4 by snap-fitting, for example.

A mirror 9 is optionally mounted adjacent to the sectional plane 6, such that it may pivot about an axis 8, which is substantially perpendicular to the sectional plane 6. The mirror 9 may be slightly greater in size than the dish 5, such that it substantially coincides with the opening 7.

At an end adjacent to the first compartment 4, the first part 2 may optionally terminate in a retainer (e.g., an axial hook) 10, which may cooperate (e.g., by reversible snap-fitting), with a correspondingly shaped retainer (e.g., compartment) 21, optionally made in an end portion 22 of the second part 20.

The other axial half of the first part 2 may form, over the sectional plane 6, a second compartment 11 (optionally hemispherical) extending over substantially the entire length of the other axial half of the first part 2. The second compartment 11 may be closed at an end opposite the first compartment 4 and open at the other end. The second compartment 11 may comprise an opening 12 oriented in a plane substantially perpendicular to the sectional plane 6 in which the first compartment opens. Alternatively, the opening 12 may be oriented in a direction not substantially perpendicular to the sectional plane 6.

The second part 20 may comprise a porition 26, adjacent to the end portion 22. Optionally the second part 20 may form a semi-cylinder complementary to the optional semi-cylinder formed by the first part 2. The portion 26, may terminate in a portion of smaller cross section 23, opposite the end portion 22. The portion 23 may facilitate insertion of the second part 20 into the opening 12. For example, the portion 23 may be inserted into the second opening 12 in a lightly clamping manner inside the edge delimiting the opening 12 of the compartment 11 formed by the first part 2.

Figure 2A:
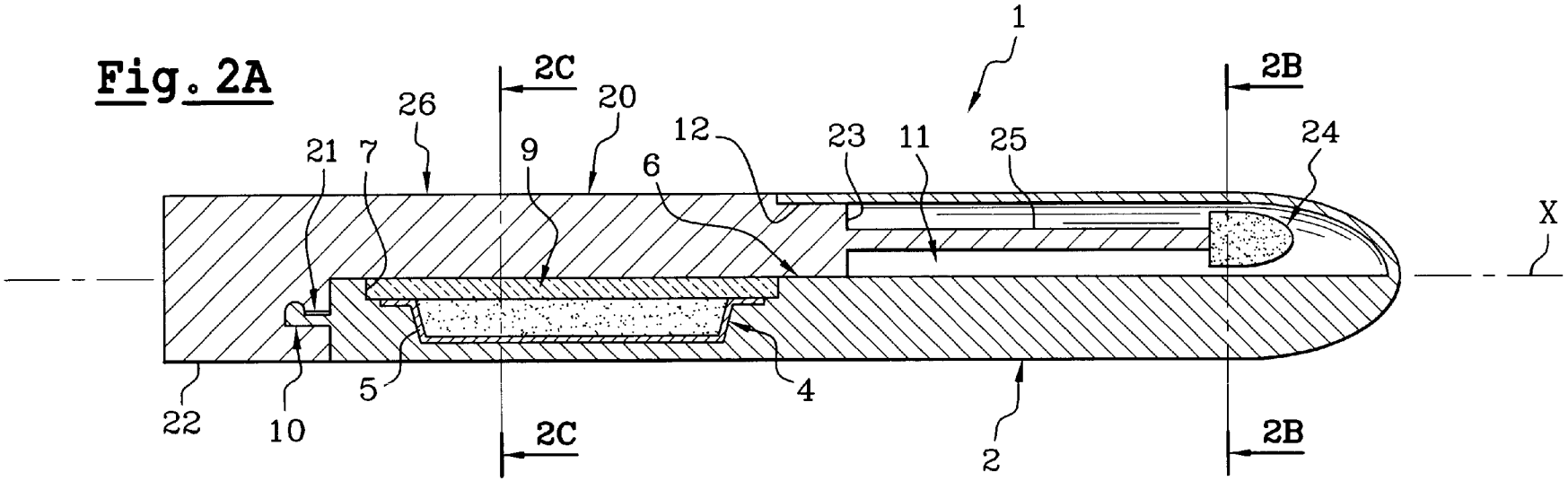
FIG. 2A is a longitudinal cross sectional view of the assembled applicator unit of FIG. 1.
Figure 2B:
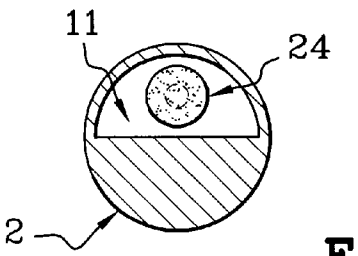
FIG. 2B is a cross sectional view along section line 2B of FIG. 2A.
Figure 2C:
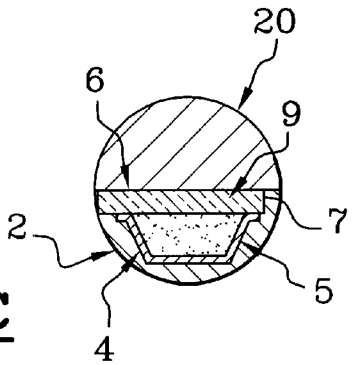
FIG. 2C is a cross sectional view along section line 2C of FIG. 2A.

The second part 20 may bear an application member 24, in the form of a block of foam, formed at the end of a rod 25 substantially along its longitudinal axis. It is contemplated that this foam could be formed integral to rod 25 during manufacturing, or it could be a separate piece affixed at the end of rod 25. Application member 24 could also comprise other materials besides foam as well. The application member 24 and the rod 25 may be designed, in the assembled position of the first part 2 and of the second part 20, as illustrated in FIG. 2A, for insertion in the second compartment 11 of the first part 2. Also in the assembled position, the second part 20 may form with first part 2 a substantially continuous exterior of the applicator unit 1. As used herein, "substantially continuous exterior" means that the second part 20 and the first part 2 form a portion of the exterior of applicator unit 1 without a substantial air gap between second part 20 and first part 2.

In the assembled position (see FIG. 2A), the application member 24 may be in the second compartment 11 of the first part 2, above the sectional plane 6. The applicator unit 1 may substantially form a cylinder of revolution, one end of which optionally terminates in a rounded portion.

To use the applicator unit 1 according to this embodiment, the user may exert a pulling movement with respect to the second part 20 in relation to the first part 2, so as to effect, by sliding along the axis X of the application unit 1, the mutual disengagement of the optional retainers 10 and 21. In doing so, the application member 24 may be withdrawn from the compartment 11, and the optional mirror 9 covering the first compartment 4 may be released. The user may then pivot the mirror 9 about the axis 8 so as to release an exposed surface of the product contained in the first compartment 4. Holding the applicator by the portion 26 of the second part 20, used in the style of a handle, the user may take up a quantity of the product contained in the dish 5 with the application member 24. She may then apply it to the surface to be treated (e.g., skin) in a conventional manner.

After application she may return the mirror to its position over the first compartment 4 and replace the application member 24 inside the second compartment 11 by sliding the second part 20 in relation to the first part 2 along the axis X, until the retainers 10 and 21 reengage. The applicator unit 1 may then be ready for reuse and can easily be carried inside a handbag, for example.

Figure 3:
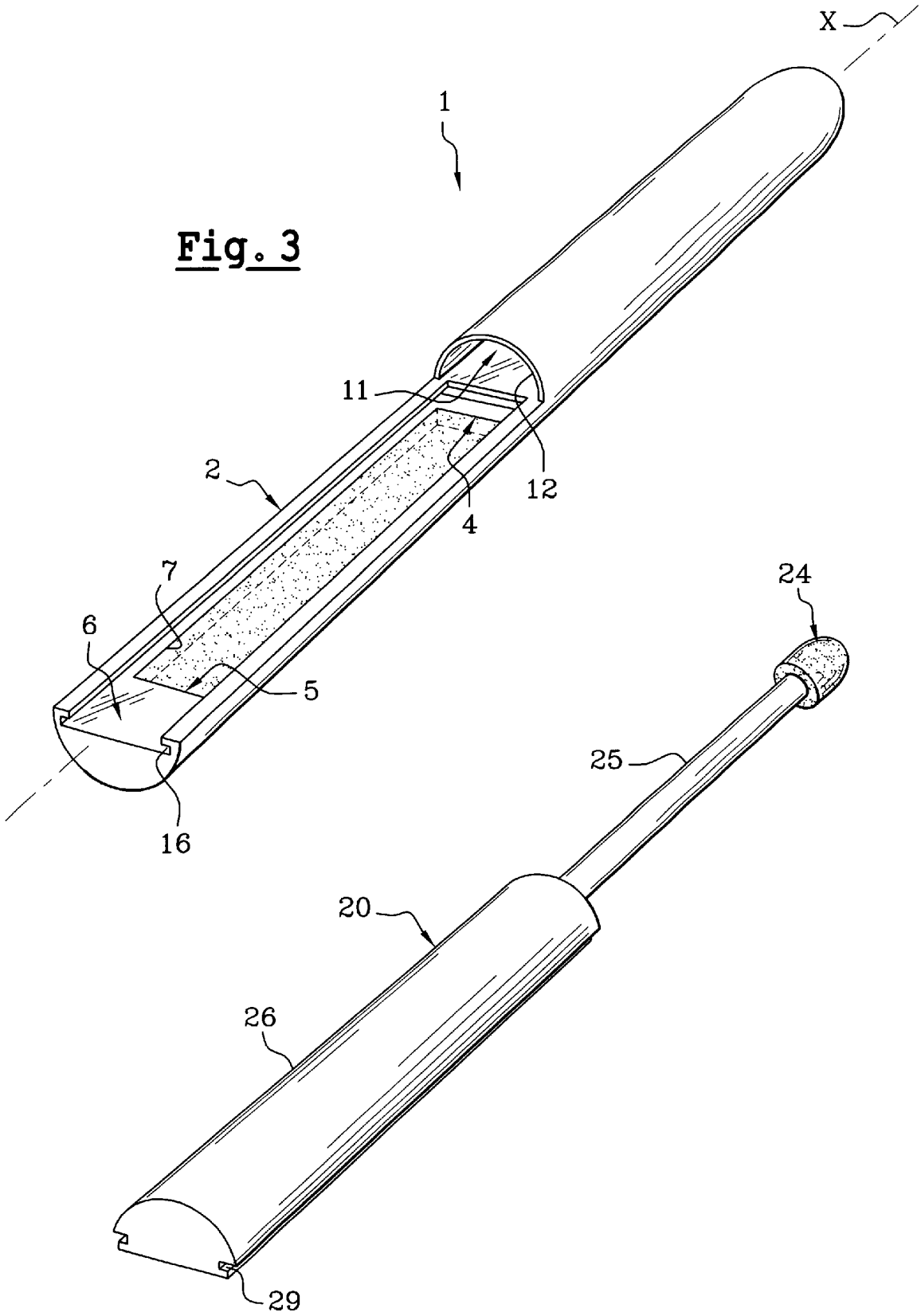
FIG. 3 is a perspective view of a disassembled applicator unit according to a second exemplary embodiment.

The embodiment illustrated in FIG. 3 may be distinguished from the previous embodiment in that the lateral edges of the first part 2 optionally form a slideway 16 in which a corresponding part 29, formed by lateral edges of the portion 26, may be guided in translation.

The sliding movement of the second part 20 with respect to the first part 2 may be guided in a sufficiently clamped manner by the slideway arrangement 16, 29, such that no additional locking parts may be needed to lock the first and second parts 2, 20 together (i.e., the slideway arrangement 16, 29 are retainers that releasably retain the first and second parts 2, 20). Furthermore, in accordance with this embodiment, the optional mirror may be excluded.

The operation and the features of the applicator unit 1 according to this alternate embodiment are substantially similar in many aspects to those discussed with reference to the previous embodiment.

Figure 4A:
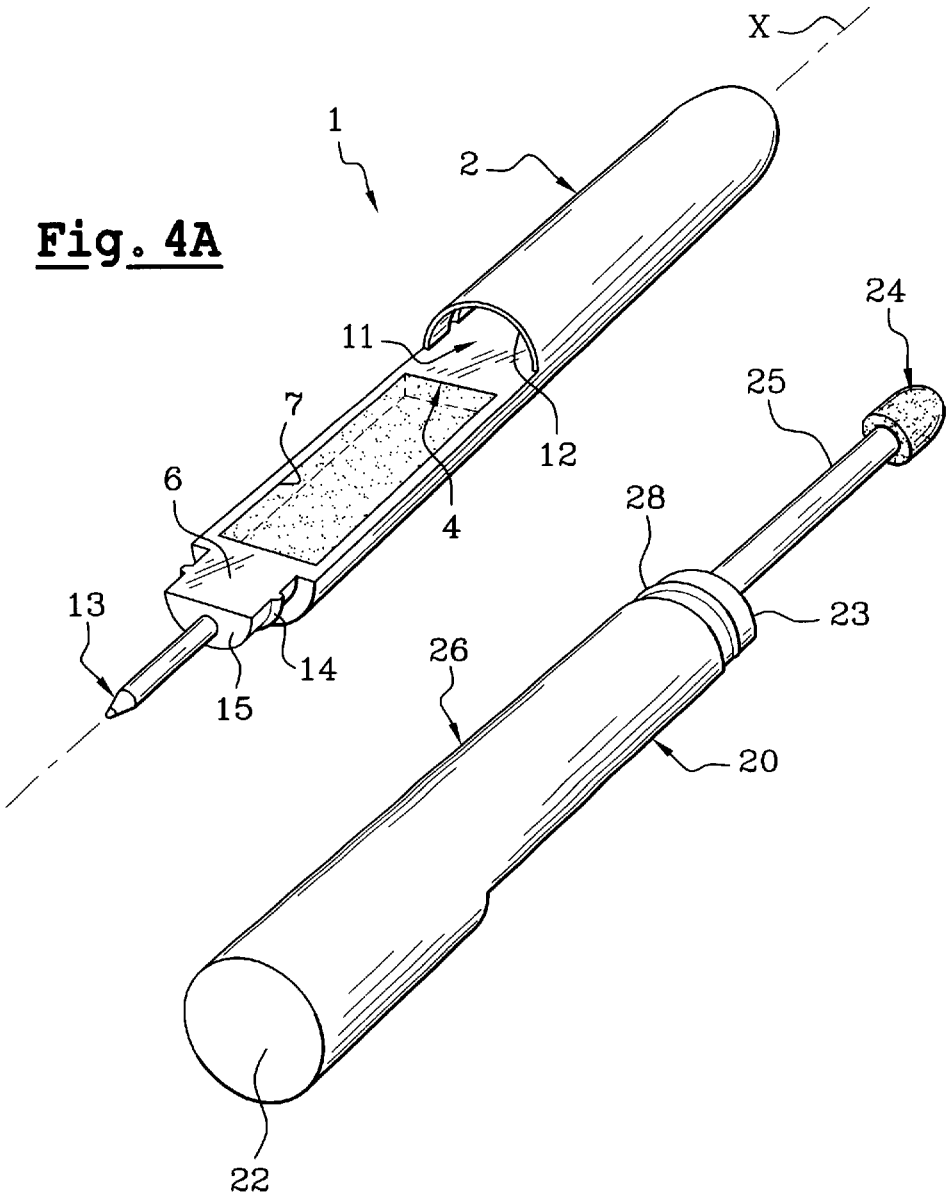
FIG. 4A is a perspective view of a disassembled applicator unit according to a third exemplary embodiment.
Figure 4B:
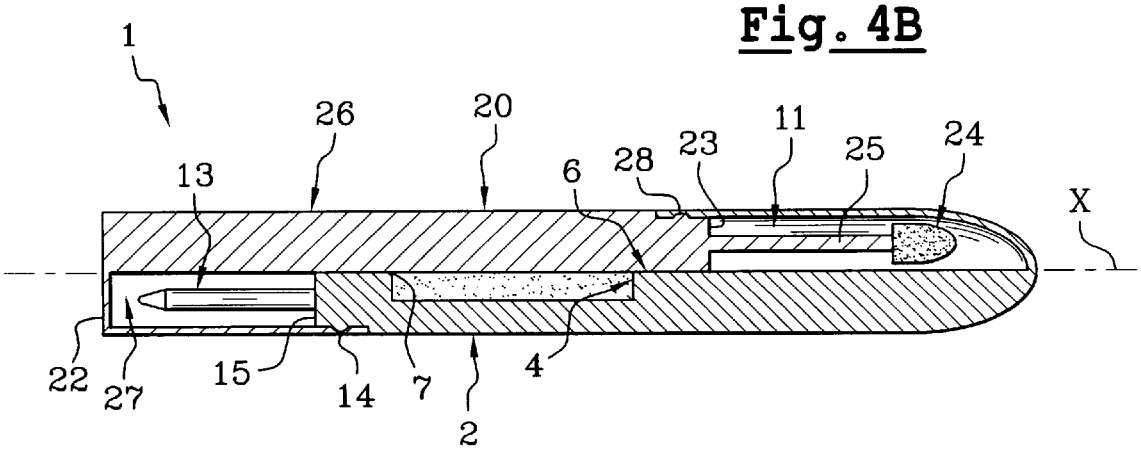
FIG. 4B is a longitudinal cross sectional view of the assembled applicator unit of FIG. 4A.

The embodiment described in FIGS. 4A and 4B may be distinguished from the embodiment illustrated in FIGS. 1 and 2A–2C in that the end of the first part 2 opposite the second compartment 11 terminates in a portion of smaller cross section 15. The portion 15 facilitates insertion inside an edge delimiting the opening of an optional third compartment 27 formed by the end portion 22 of the second part 20. A retainer 14 (e.g., bulge) on the portion 15 can cooperate with a corresponding retainer (e.g., groove) formed on the internal surface of the third compartment 27 so as to provide a snap-fit connection when assembling the first part 2 and the second part 20. In the assembled position illustrated in FIG. 4B, the third compartment 27 is on the side of the plane 6 opposite the second compartment 11 formed by the first part 2.

The embodiment of FIGS. 4A and 4B may be further distinguished in that the portion 15 of the first part 2 optionally terminates in a second application member 13 (e.g., in the form of a pencil), oriented substantially axially. In the assembled position, as illustrated in FIG. 4B, the applicator 13 may be located inside the compartement 27 formed by the second part 20.

Also, as with the optional portion of reduced cross section 15 of the first part 2, the portion of reduced cross section 23 of the second part 20 may form a retainer (e.g., bulge) 28 able to cooperate with a retainer (e.g., groove) formed by the internal surface of the second compartment 11 formed by the first part 2.

In addition, the product may be contained directly in the first compartment 4 in the first part 2. As with the embodiment illustrated in FIG. 3, the applicator unit according to this embodiment may or may not include a mirror.

The operation of the applicator unit according to the embodiment of FIGS. 4A and 4B is substantially similar to that of the previous embodiments, except that the applicator unit includes a second application member 13. As such, product may be applied with an appliction member 24, application member 13, or both, on identical or different surfaces.

It will be apparent to those skilled in the art that various modifications and variations can be made to the structure. Thus, it should be understood that the invention is not limited to the examples discussed in the specification. Rather, the present invention is intended to cover modifications and variations.

What is claimed is:

1. An applicator unit, comprising:

an application member;

a first part defining at least a first compartment and a second compartment, the first compartment being configured to accommodate a product to be applied and comprising a first opening extending substantially in a plane, the second compartment being configured to accommodate the application member via a second opening;

a second part comprising a handle, the application member being located at an end of the handle; and a retainer configured to releasably retain the first and second parts in an assembled position, wherein the first and second parts are configured so that, in the assembled position:

the first and second openings are closed, the handle is arranged at least partially over the first opening, the handle defines a portion of the external surface of the unit, and the application member is arranged in the second compartment on an opposite side of the plane than the first compartment.

2. The applicator unit of claim 1, wherein the retainer is configured to reversibly lock the first part and the second part together in the assembled position.

3. The applicator unit of claim 1, wherein a cross sectional area of the handle in a plane parallel to the plane of the first opening is at least as large as an area of the first opening, such that the handle is capable of covering the first opening entirely.

4. The applicator unit of claim 3, wherein, in the assembled position, the handle seals the first opening in a leak-tight manner.

5. The applicator unit of claim 1, wherein the first part further comprises a mirror.

6. The applicator unit of claim 5, wherein, in the assembled position, the handle covers an entire reflecting surface of the mirror.

7. The applicator unit of claim 5, wherein the mirror is configured to at least partially cover the first opening and is movable in relation to a remainder of the first part.

8. The applicator unit of claim 7, wherein the mirror is slidable in relation to the first part.

9. The applicator unit of claim 7, wherein the mirror is movable about an axis perpendicular to the plane of the first opening.

10. The applicator unit of claim 7, wherein, in the assembled position, the handle and the mirror cooperate to seal the first opening in a leak-tight manner.

11. The applicator unit of claim 5, wherein the mirror is fixedly mounted on the first part.

12. The applicator unit of claim 11, wherein the mirror is fixedly mounted next to the first opening.

13. The applicator unit of claim 1, wherein the first and second compartments are offset from one another along the length of the applicator unit.

14. The applicator unit of claim 13, wherein the first and second compartments are formed in a single piece of material.

15. The applicator unit of claim 1, wherein the first and second compartments are formed in a single piece of material.

16. The applicator unit of claim 1, wherein the first part is formed from a single piece of material.

17. The applicator unit of claim 16, wherein the first part is formed by molding.

18. The applicator unit of claim 1, wherein the second part is formed from a single piece of material.

19. The applicator unit of claim 18, wherein the second part is formed by molding.

20. The applicator unit of claim 1, wherein the application member is axially fixed with respect to the handle.

21. The applicator unit of claim 1, wherein the retainer comprises a slideway configured to guide a relative sliding movement of one of the first part and second part with respect to the other of the first part and the second part.

22. The applicator unit of claim 2, wherein the retainer is configured to provide one of snap-fitting and clamping of the first and second parts together.

23. The applicator unit of claim 1, wherein, in the assembled position, the applicator unit has a generally cylindrical shape.

24. The applicator unit of claim 23, wherein the applicator unit has a cross sectional shape perpendicular to a longitudinal axis of the applicator unit chosen from one of a circular shape, a hexagonal shape, a square shape, an oval shape, and a rectangular shape.

25. The applicator unit of claim 1, wherein the application member comprises one of a foam, a felt, a sintered material, and an arrangement of bristles.

26. The applicator unit of claim 25, wherein the application member comprises the foam, and wherein the foam comprises one of open, semi-open, and closed cells.

27. The applicator unit of claim 25, wherein the application member comprises the sintered material, and wherein the sintered material comprises one of a ceramic and a thermoplastic.

28. The applicator unit of claim 25, wherein the application member comprises the arrangement of bristles, and wherein the arrangement of bristles is in the form of a tuft substantially parallel to a longitudinal axis of the handle.

29. The applicator unit of claim 1, further comprising a dish located in the first compartment, the dish being configured to accommodate the product.

30. The applicator unit of claim 29, wherein the dish is removable from the first compartment.

31. The applicator unit of claim 1, further comprising a second application member.

32. The applicator unit of claim 31, wherein the second application member comprises a make-up pencil.

33. The applicator unit of claim 31, wherein the second application member is secured to the first part and is configured so that, in the assembled position, the second application member is housed in a compartment formed in the second part.

34. The applicator unit of claim 1, further comprising product contained in the first compartment, wherein the product comprises a cosmetic product.

35. The applicator unit of claim 34, wherein the cosmetic product is in the form of one of a solid cake and a semi-solid cake.

36. The applicator unit of claim 34, wherein the cosmetic product is chosen from eyeshadows, blushers, foundations, lip make-ups, and mascaras.

37. The applicator unit of claim 1, wherein the first part is configured such that the first and second compartments are fixed with respect to one another.

38. The applicator unit of claim 1, wherein the first part is configured such that the first and second openings are fixed with respect to one another.

39. A method of applying a product, comprising:

providing the applicator unit of claim 1 with a product contained in the first compartment;

separating the first part and the second part from one another;

loading product onto the application member; and applying product to an exterior body portion with the application member.

40. The method of claim 39, wherein the exterior body portion comprises skin.

41. The method of claim 39, wherein the retainer is configured to lock the first and second parts together, and wherein the separating of the first part from the second part comprises unlocking the first part and the second part in a same motion used to separate the first part and the second part.

42. The method of claim 39, wherein the product is chosen from one of eyeshadows, blushers, foundations, lip make-ups, and mascaras.

43. An applicator unit, comprising:

an application member;

a first part defining at least a first compartment and a second compartment, the first compartment being configured to accommodate a product to be applied and comprising a first opening extending substantially in a plane, the second compartment being configured to accommodate the application member via a second opening;

a second part comprising a handle, the application member being located at an end of the handle; and a retainer configured to releasably retain the first and second parts in an assembled position, wherein the first opening is fixed in relation to the second opening, and wherein the first and second parts are configured so that, in the assembled position:

the handle and the first part cooperate to form at least part of a substantially continuous exterior surface, and the application member is arranged in the second compartment on an opposite side of the plane than the first compartment.

44. The applicator unit of claim 43, wherein, in the assembled position, the first and second openings are closed.

45. The applicator unit of claim 43, wherein the second opening faces in a direction that is not parallel to a direction that the first opening faces.

46. The applicator unit of claim 43, wherein the first opening and the second opening are offset from one another along a longitudinal axis of the applicator unit.

47. An applicator unit, comprising:

an application member;

a first part defining at least a first compartment and a second compartment, the first compartment being configured to accommodate a product to be applied and comprising a first opening extending substantially in a plane, the second compartment being configured to accommodate the application member via a second opening;

a second part comprising a handle, the application member being located at an end of the handle; and a retainer configured to releasably retain the first and second parts in an assembled position, wherein the first opening is fixed in relation to the second opening, wherein the first opening and the second opening are offset from one another along a longitudinal axis of the applicator unit, and wherein the first and second parts are configured so that, in the assembled position, the application member is arranged in the second compartment on an opposite side of the plane than the first compartment.

48. The applicator unit of claim 47, wherein, in the assembled position, the first and second openings are closed.

49. The applicator unit of claim 47, wherein the second opening faces in a direction that is not parallel to a direction that the first opening faces.

50. An applicator unit, comprising:

a first application member;

a second application member;

a first part defining at least a first compartment and a second compartment, the first compartment being configured to accommodate a product to be applied and comprising a first opening extending substantially in a plane, the second compartment being configured to accommodate the first application member via a second opening;

a second part comprising a handle, the first application member being located at an end of the handle; and a retainer configured to releasably retain the first and second parts in an assembled position, wherein the first and second parts are configured so that, in the assembled position, the first application member is arranged in the second compartment on an opposite side of the plane than the first compartment.

51. The applicator unit of claim 50, wherein, in the assembled position, the first and second openings are closed.

52. The applicator unit of claim 50, wherein the second application member comprises a make-up pencil.

53. The applicator unit of claim 50, wherein the second application member is secured to the first part, and wherein, in the assembled position, the second application member is housed in a compartment formed in the second part.

* * * * *